US011219910B2

(12) United States Patent
Driskell

(10) Patent No.: US 11,219,910 B2
(45) Date of Patent: Jan. 11, 2022

(54) TRIGGER SPRAYER WITH IMPROVED VENTING SYSTEM AND METHODS OF USING THE SAME

(71) Applicant: Silgan Dispensing Systems Corporation, Grandview, MO (US)

(72) Inventor: William L. Driskell, Grandview, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/566,575

(22) Filed: Sep. 10, 2019

(65) Prior Publication Data

US 2021/0069738 A1 Mar. 11, 2021

(51) Int. Cl.
*B05B 11/00* (2006.01)

(52) U.S. Cl.
CPC ..... *B05B 11/3011* (2013.01); *B05B 11/007* (2013.01); *B05B 11/3057* (2013.01)

(58) Field of Classification Search
CPC . B05B 11/3011; B05B 11/007; B05B 11/3057
USPC ..... 222/383.1
See application file for complete search history.

(56) References Cited

U.S. PATENT DOCUMENTS 4,624,413 A * 11/1986 Corsette ..... B05B 1/3431 239/333
4,747,523 A * 5/1988 Dobbs ..... B05B 11/3061 222/383.1
5,244,126 A * 9/1993 Geier ..... B05B 11/3011 222/383.1
5,385,302 A * 1/1995 Foster ..... B05B 1/3431 239/333
5,425,482 A * 6/1995 Foster ..... B05B 1/3431 222/207
5,462,209 A * 10/1995 Foster ..... B05B 11/0059 222/376
5,467,900 A * 11/1995 Maas ..... B05B 11/007 222/341
5,467,901 A * 11/1995 Foster ..... B05B 11/0059 222/376
5,509,608 A * 4/1996 Foster ..... B05B 1/3431 239/333

(Continued)

*Primary Examiner* — Paul R Durand
*Assistant Examiner* — Michael J. Melaragno
(74) *Attorney, Agent, or Firm* — Barlow, Josephs & Holmes, Ltd.; Stephen J. Holmes

(57) ABSTRACT

A sprayer device with a trigger operated pump is operative for pumping and spraying liquid from an attached liquid container. The trigger sprayer includes valve body provided with a base portion that is configured to be mounted to the neck of the liquid container and a delivery nozzle from which the liquid is sprayed. A fluid flow path extends from the base portion to the delivery nozzle. A pumping chamber is in fluid communication with the flow passage and there is a vent opening between the pumping chamber and the interior of said base. A piston with spaced inboard and outboard seals is movable in the pumping chamber and the vent opening is located between the seals. A check valve is disposed between the vent opening and the interior of the base portion to prevent liquid from the container from backflowing into the pumping chamber during shipment and handling.

16 Claims, 7 Drawing Sheets

(56) References Cited

U.S. PATENT DOCUMENTS 5,522,547 A * 6/1996 Dobbs ..... B05B 1/3436 239/333
5,549,249 A * 8/1996 Foster ..... B05B 1/3431 239/463
5,562,250 A * 10/1996 O'Neill ..... B05B 11/3004 222/136
5,575,407 A * 11/1996 Foster ..... B05B 1/3431 222/324
5,590,834 A * 1/1997 Foster ..... B05B 11/0005 239/333
5,593,093 A * 1/1997 Foster ..... B05B 1/3431 239/333
5,622,317 A * 4/1997 Foster ..... B05B 11/0064 239/333
5,697,556 A * 12/1997 Foster ..... B05B 11/0064 239/333
5,711,461 A * 1/1998 Foster ..... B05B 11/0064 222/383.1
5,716,008 A * 2/1998 Nottingham ..... B05B 11/303 239/333
5,881,956 A * 3/1999 Cohen ..... B05B 11/3077 239/333
5,884,845 A * 3/1999 Nelson ..... B05B 1/3431 239/333
6,116,472 A * 9/2000 Wanbaugh ..... B05B 11/3011 222/340
6,126,090 A * 10/2000 Wadsworth ..... B05B 1/12 222/380
6,131,820 A * 10/2000 Dodd ..... B05B 11/007 239/106
6,286,723 B1 * 9/2001 Sweeton ..... B05B 11/3057 222/153.13
6,550,694 B1 * 4/2003 Foster ..... B05B 11/3011 222/137
6,641,003 B1 * 11/2003 Foster ..... B05B 11/007 222/383.1
6,715,698 B2 * 4/2004 Foster ..... B05B 1/3468 239/333
6,729,560 B2 * 5/2004 Foster ..... B05B 11/3011 222/137
6,869,027 B2 * 3/2005 Foster ..... B05B 11/3009 222/383.1
7,175,056 B2 * 2/2007 Buti ..... B05B 11/3011 222/340
7,938,299 B2 * 5/2011 Fahy ..... B05B 11/3045 222/382
2007/0215647 A1 * 9/2007 Foster ..... B05B 11/3077 222/383.1
2007/0295758 A1 * 12/2007 Foster ..... B05B 11/3011 222/383.1
2008/0105713 A1 * 5/2008 Fahy ..... B05B 11/3045 222/382
2008/0149671 A1 * 6/2008 Sweeton ..... B05B 11/0064 222/383.1
2008/0230563 A1 * 9/2008 Maas ..... B05B 11/3069 222/383.1
2009/0152304 A1 * 6/2009 Foster ..... B05B 11/3011 222/340
2009/0308897 A1 * 12/2009 Foster ..... B05B 11/3064 222/383.1
2010/0155425 A1 * 6/2010 Alluigi ..... B05B 15/652 222/153.09
2011/0174843 A1 * 7/2011 Rech ..... B05B 11/0059 222/376
2011/0240681 A1 * 10/2011 Foster ..... B05B 11/3011 222/383.1
2013/0008923 A1 * 1/2013 Syson ..... B05B 11/0044 222/189.09
2013/0026192 A1 * 1/2013 Alluigi ..... B05B 11/3011 222/383.1
2013/0161359 A1 * 6/2013 Alluigi ..... B05B 11/3069 222/383.1
2013/0221033 A1 * 8/2013 Alluigi ..... B05B 11/3064 222/383.1
2013/0256339 A1 * 10/2013 Alluigi ..... B05B 11/3011 222/383.1
2014/0110439 A1 * 4/2014 Tada ..... B65D 43/02 222/383.1
2014/0224842 A1 * 8/2014 Alluigi ..... B05B 11/3045 222/380
2015/0041490 A1 * 2/2015 Alluigi ..... B05B 15/30 222/383.1
2015/0151316 A1 * 6/2015 Alluigi ..... B05B 11/3057 222/383.1
2015/0336123 A1 * 11/2015 Hoffmann ..... B05B 11/3005 222/153.14
2016/0144387 A1 * 5/2016 Alluigi ..... B05B 11/3011 222/383.1
2016/0158780 A1 * 6/2016 Alluigi ..... B05B 11/3069 222/383.1

* cited by examiner

TRIGGER SPRAYER WITH IMPROVED VENTING SYSTEM AND METHODS OF USING THE SAME

BACKGROUND OF THE INVENTION

(1) Field of the Invention

The instant invention relates to sprayer dispensing devices and more particularly to a trigger sprayer with an improved venting system which prevents leakage during shipping and handling.

(2) Description of Related Art

A trigger sprayer of the type generally contemplated herein comprises a valve body provided with a base configured to be mounted to neck of a liquid container, a delivery nozzle from which the liquid is sprayed, a spring-biased trigger lever that is operated manually by the user and a pump operated by the trigger lever to suction liquid from the container and to spray it through the nozzle. The pump includes a piston acting in a vented pumping chamber formed in the valve body.

While the existing pump sprayers are effective for their intended purposes, an ever-evolving consumer and delivery market requires novel and improved designs which provide for added functionality, improved connection points and reduced leak points.

SUMMARY OF THE INVENTION

An exemplary embodiment comprises a sprayer device with a trigger operated pump that is operative for pumping and spraying liquid from an attached liquid container.

The trigger sprayer includes valve body generally provided with a base portion that is configured to be mounted to the neck of a liquid container and a delivery nozzle from which the liquid is sprayed. The exemplary base portion may be mounted and/or received on the container neck with a threaded collar, may be snap received or may be attached with a bayonet connection, or other suitable spray head connection.

The valve body includes a fluid flow path that extends from the base portion to the delivery nozzle to deliver liquid from the container to the nozzle. In some embodiments, a dip tube retainer is received into the valve body. The dip tube retainer includes a body portion which is snap received into the interior of the base of the valve body and further includes an upwardly extending stem received into the fluid flow path. A dip tube is received into a lower end of the stem and extends down into the container.

The body of the clip tube retainer includes a vent path to permit air to pass between the interior of the base portion of the valve body and the interior of the container.

A trigger operated pump includes a pumping chamber, a piston, a spring, and a trigger lever that operates to draw fluid from the container up through the dip tube and deliver it to the delivery nozzle. The pumping chamber is in fluid communication with the flow passage through an aperture in the upper portion of the pumping chamber and there is a vent opening between the pumping chamber and the interior of said base. A piston with spaced inboard and outboard seals is movable in the pumping chamber and the vent opening is located between the seals. To prevent liquid from the container from backflowing or leaking into the pumping chamber through the vent opening during shipment and handling, a check valve is disposed between the vent opening and the interior of the base portion.

In some embodiments, an exemplary check valve may comprise a valve seat which extends downwardly from the pumping chamber wall into the interior of the base portion and a valve body received into the valve seat.

In other embodiments, an exemplary check valve is integrated as part of the dip tube retainer. In this regard, the vent opening provides a direct air passage into the interior of the base portion of the valve body and the check valve checks flow from the container through the vent in the body of the dip tube retainer. More specifically, a valve seat protrudes upwardly from the body of the dip tube retainer into the interior of the base portion towards the vent opening and the valve body is located within the valve seat, received therein from beneath the dip tube retainer.

It can thus be appreciated that the exemplary embodiment provides a unique valve body, trigger pump and check valve assembly which simplifies and reduces the number of parts while also reducing the number of potential leak points between the liquid container and the valve body.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

and

Figure 9:
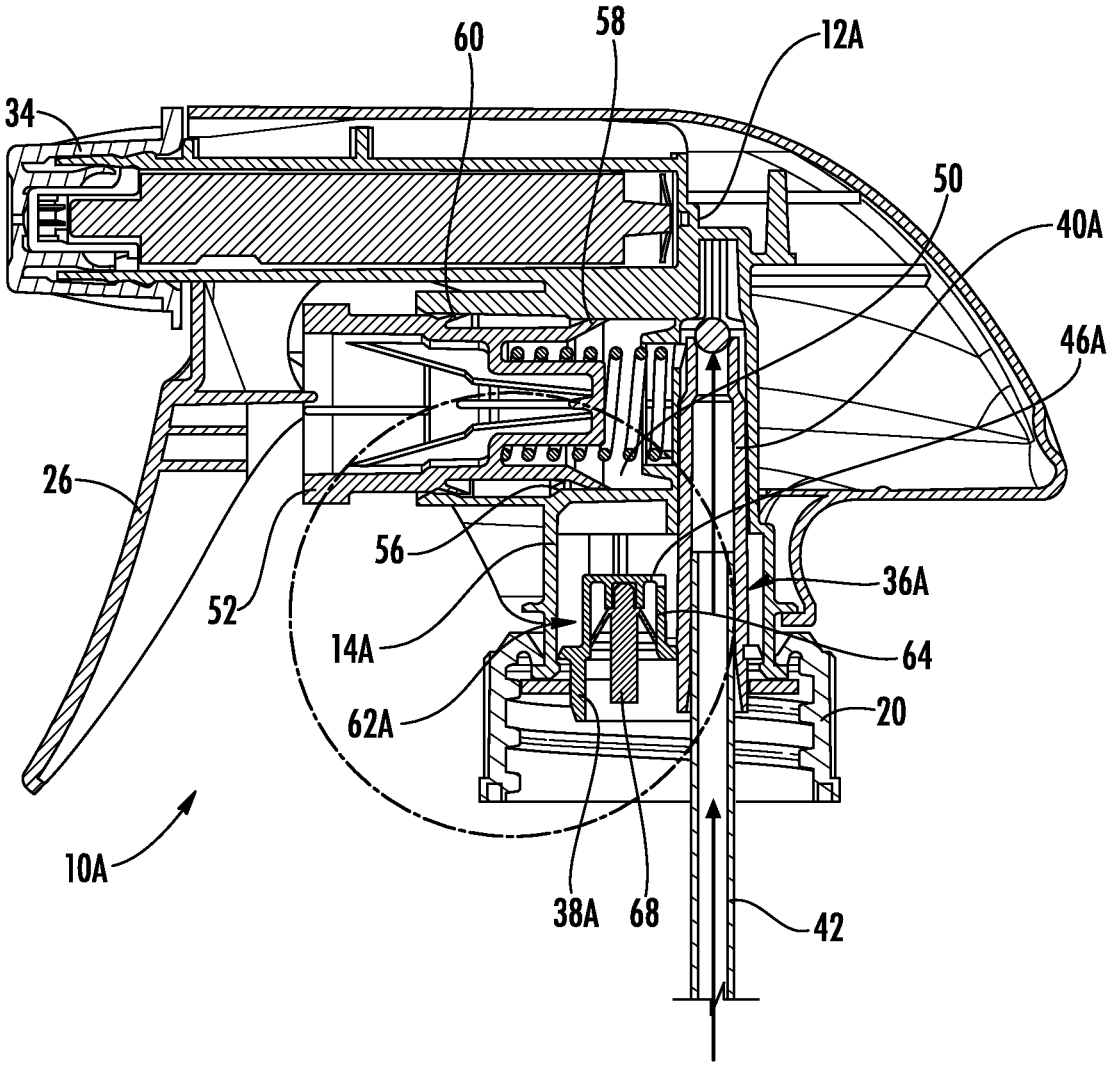
FIG. 9 is a cross-sectional view thereof taken along line A-A of FIG. 7.
Figure 10:
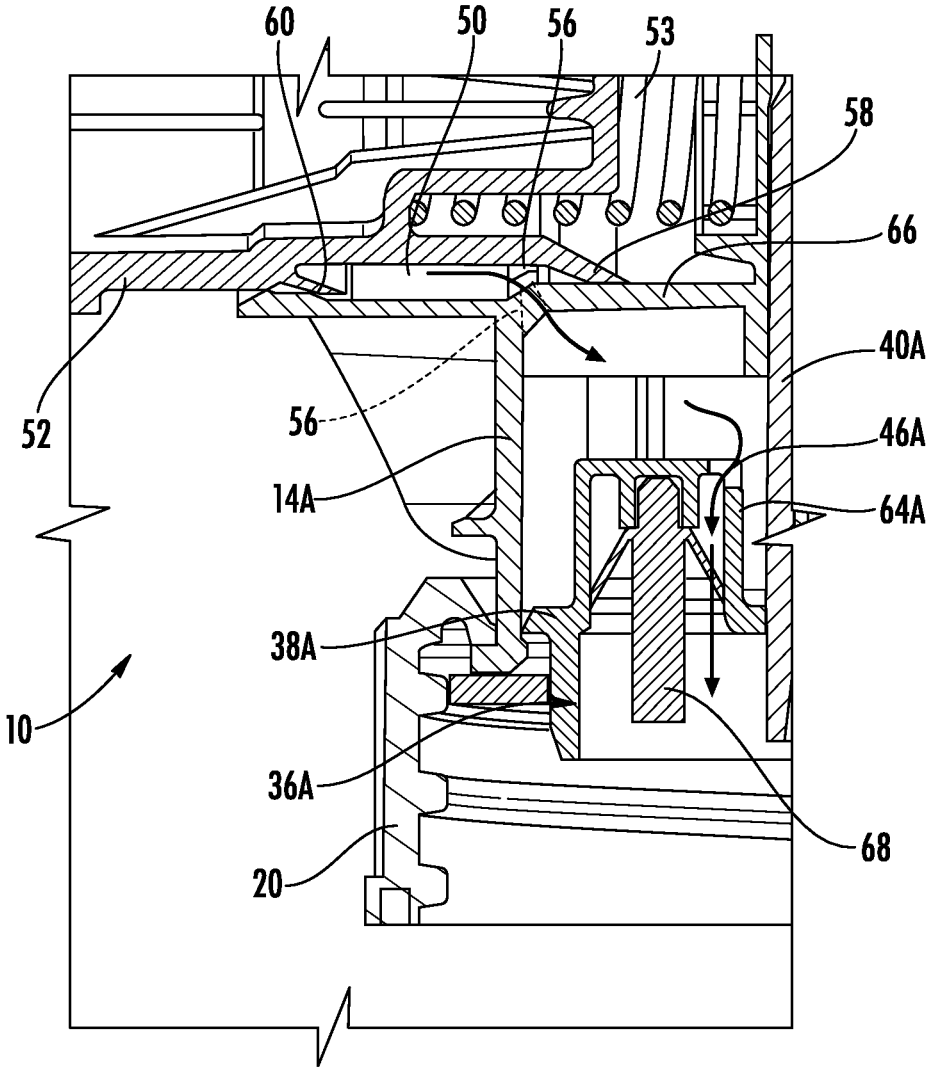

FIG. 10 is an enlarged detail view of the vent passage and vent body taken from FIG. 9.

DETAILED DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments.

Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Referring now to the drawings, an exemplary embodiment of a trigger sprayer 10 is illustrated in FIGS. 1-6. While reference is made to trigger sprayers for liquids, it should be understood that the presently described types of spray devices can also be used to spray any type of fluids.

The exemplary trigger sprayer 10 comprises an integrally molded valve body 12 provided with a base portion 14 that is configured to be mounted to a neck 16 of a liquid container 18. The exemplary base portion 14 may be snap fit or plug fit onto the neck 16 of the container 18 or may include a bayonet type connection, or threaded closure ring 20 or any other connection as known in the art. A gasket 22 may be received between the valve body 12 and the neck 16 of the container 18.

Figure 1:
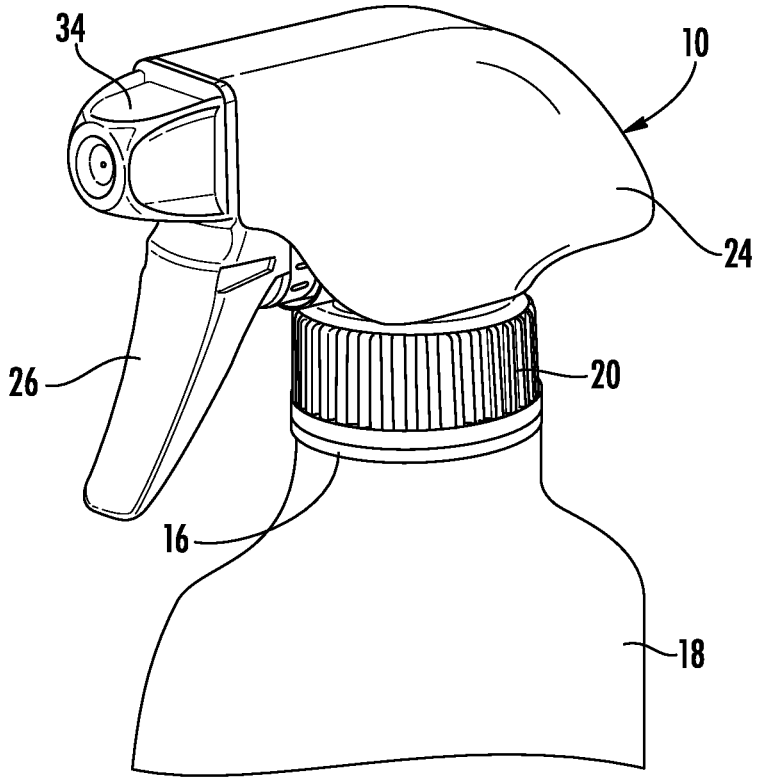
FIG. 1 is a perspective view of an exemplary embodiment of a trigger sprayer having a vent check valve in accordance with the present invention.
Figure 2:
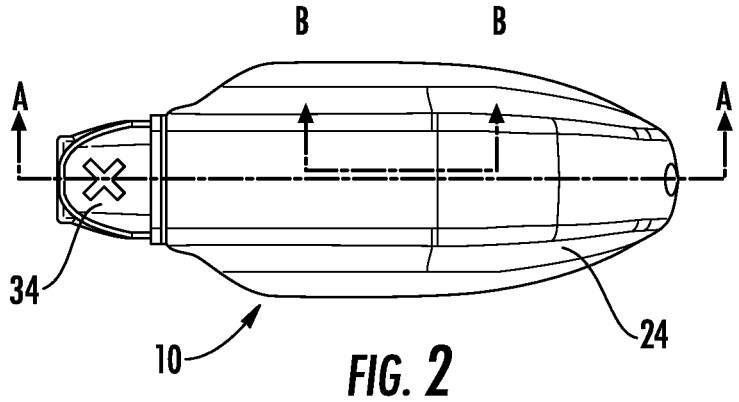
FIG. 2 is a top view thereof.
Figure 3:
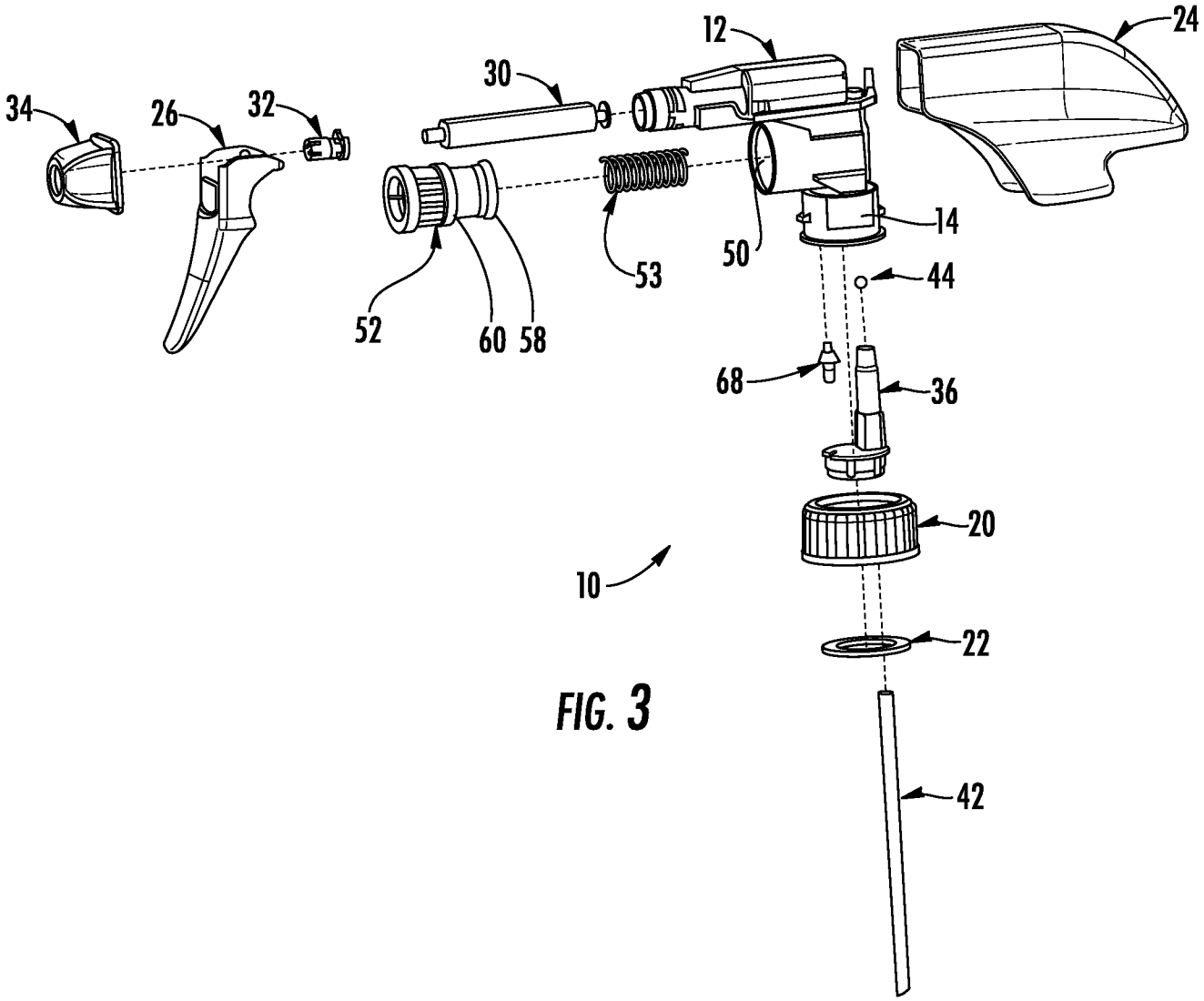
FIG. 3 is an exploded perspective view thereof.

Referring to FIG. 3, the trigger sprayer 10 further includes a contoured shroud 24 which encloses the valve body 12 at the rear, a trigger lever 26, and a discharge assembly 28 comprising a discharge valve 30, a spin mechanic 32 which controls the discharge spray pattern and a nozzle 34.

Figure 4:
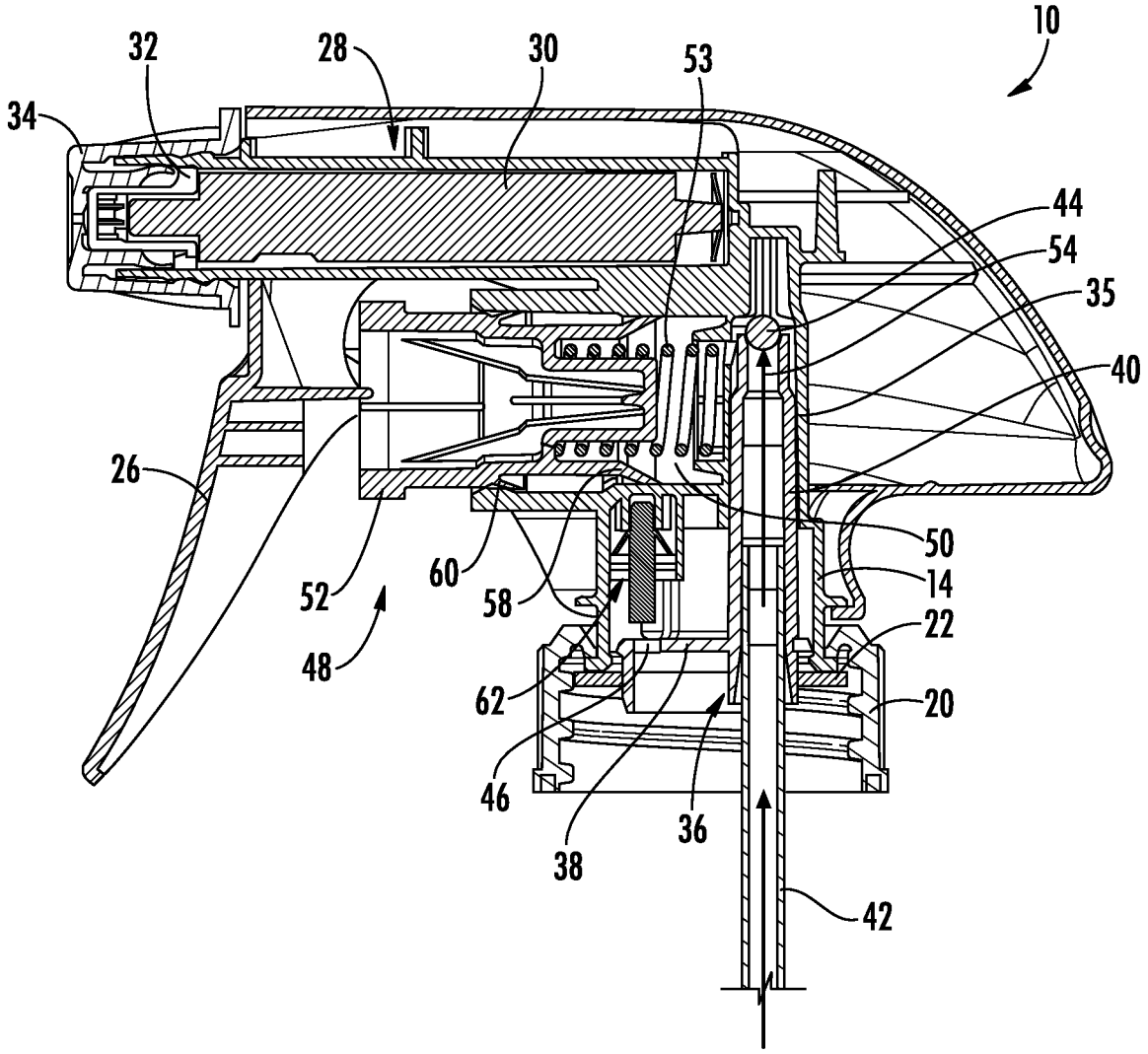
FIG. 4 is a cross-sectional view thereof taken along line A-A of FIG. 2.
Figure 5:
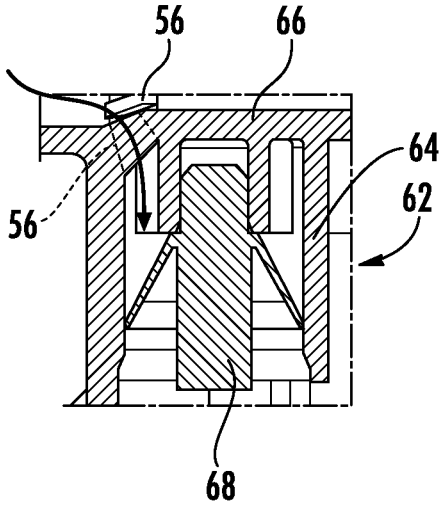
FIG. 5 is an enlarged detail view of the vent passage and vent body taken from FIG. 4.
Figure 6:
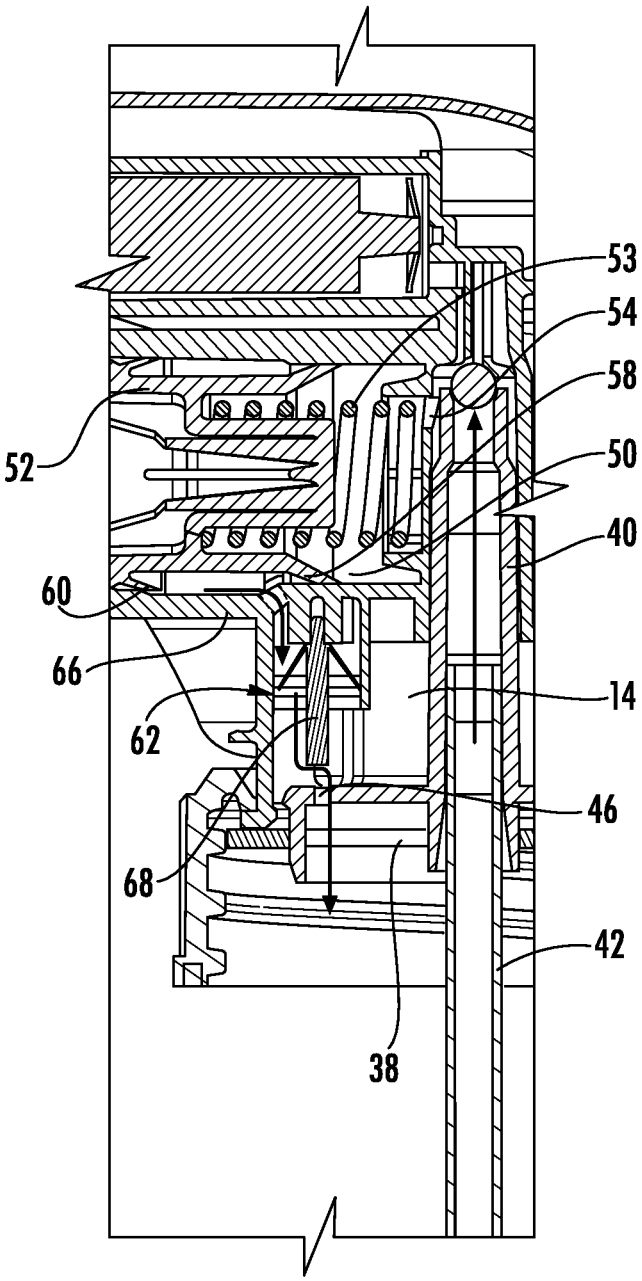
FIG. 6 is a cross-sectional view thereof taken along line B-B of FIG. 2.
Figure 7:
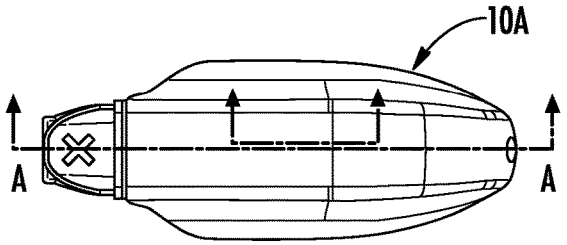
FIG. 7 is a top view of another exemplary embodiment of a trigger sprayer according to the invention.

Turing to FIGS. 4-6, the valve body 12 includes a liquid flow passage 35 (see flow arrows) that extends from the interior of the base portion 14 up through the valve body 12 to the delivery nozzle 34 to deliver liquid from the container 18 to the delivery nozzle 34. In some embodiments, a dip tube retainer 36 is received into the base portion 14 of the valve body 12. The dip tube retainer 36 includes a disc-shaped body portion 38 which is snap received into the interior of the base portion 14 of the valve body 12 and further includes an upwardly extending stem 40 which is received into the fluid flow passage 35. A dip tube 42 is received into a lower end of the stem 40 and extends down into the container 18 to provide a continuous flow path from the bottom of the container 18 to the delivery nozzle 34. A ball valve 44 is located at the upper end of the stem 40.

The body 38 of the dip tube retainer 36 includes a vent path 46 to permit air to pass between the interior of the base portion 14 of the valve body 12 and the interior of the container 18.

A trigger operated pump mechanism 48 includes a pumping chamber 50, a piston 52, a spring 53, and the trigger lever 26 that operates to draw fluid from the container 18 up through the dip tube 42 and deliver it to the delivery nozzle 34. The pumping chamber 50 is in fluid communication with the flow passage 35 through an aperture 54 in the upper portion of the pumping chamber 50 and there are vent openings 56 between the pumping chamber 50 and the interior of the base portion 14 of the valve body 12. The vent opening(s) 56 is/are more clearly shown in broken lines in enlarged FIG. 5, and also in the additional cross-sectional view in FIG. 6. Turning back to FIG. 4, the piston 52 includes spaced inboard and outboard chevron seals 58, 60 and is slidably movable within the pumping chamber 50 by operation of the trigger lever 26. The vent openings 56 are located between the seals 58, 60 and allow atmospheric air to pass during movement of the piston 52. To prevent liquid from the container 18 from backflowing or leaking into the pumping chamber 50 during shipment and handling, a check valve is disposed between the vent openings 56 and the interior of the base portion 14.

In some embodiments, an exemplary check valve 62 may comprise a valve seat 64 which extends downwardly from the pumping chamber wall 66 into the interior of the base portion 14 and a valve body 68 received into the valve seat 64 (best seen in FIG. 5). The valve seat 64 may be cylindrical and is in communication with the vent openings 56. The exemplary valve body 68 is elastomeric and may comprise an annular, chevron type one-way valve body which allows air to pass from the vent openings 56 into the interior of the base portion 14 of the valve body 12, but prevents liquid from the container 18 from travelling back through the vent openings 56.

Referring now to FIGS. 7-10, in another exemplary embodiment 10A, an exemplary check valve configuration 62A is integrated as part of the dip tube retainer 36A instead of within the base 14 of the valve body 12. Otherwise, the valve body 12, shroud 24 and discharge components 28 as described hereinabove are the same.

Figure 8:
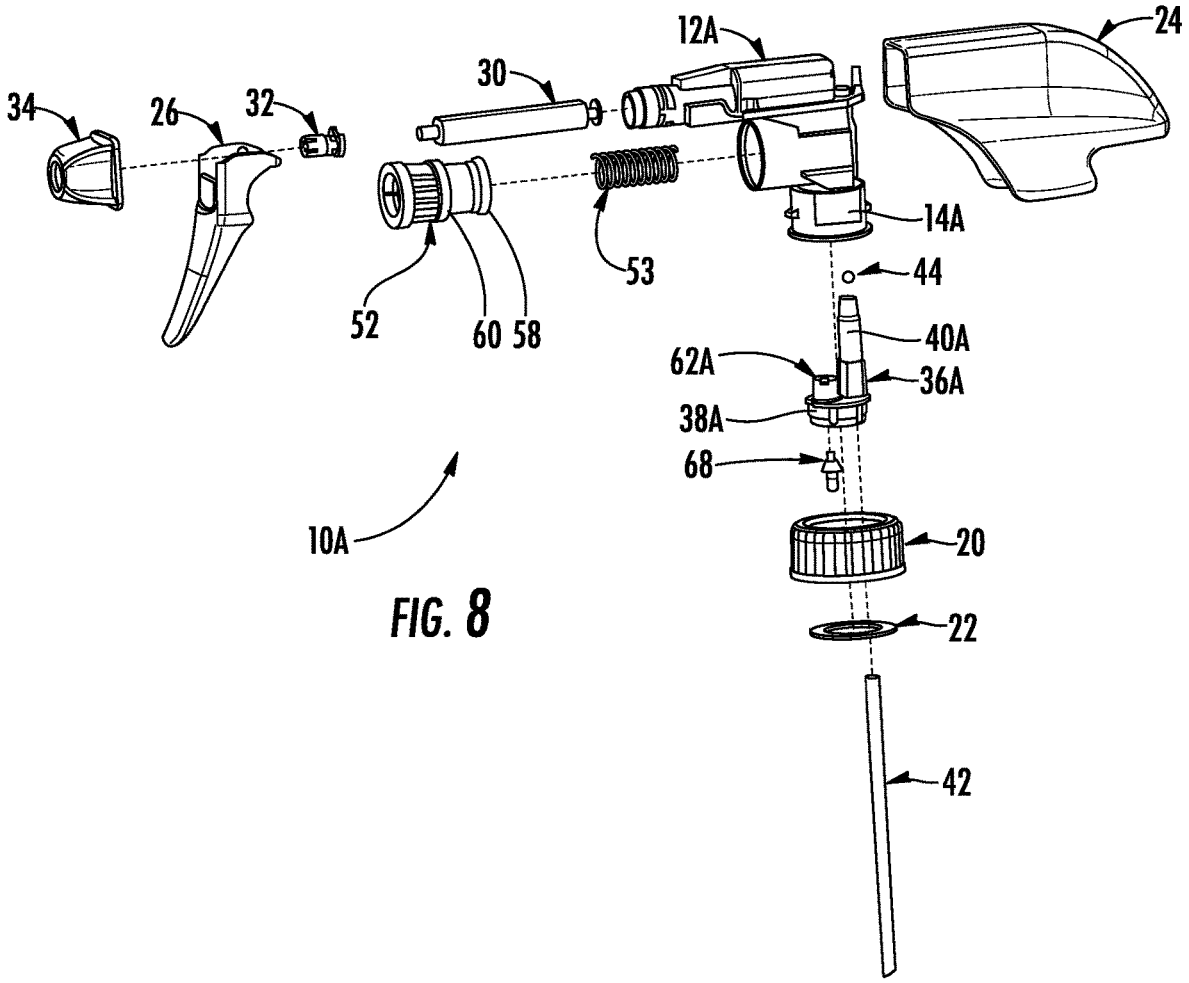
FIG. 8 is an exploded perspective view thereof.

With regard to the check valve configuration 62A, the vent openings 56A provide a direct air passage into the interior of the base portion 14A of the valve body 12A and the check valve 62A checks liquid flow from the container 18 through a vent opening 46A in the body 38A of the dip tube retainer 36A (See FIGS. 9 and 10). As best seen in FIGS. 8-10, the valve seat 64A protrudes upwardly from the body 38A of the dip tube retainer 36A into the interior of the base portion 14A towards the vent openings 56, and the valve body 68 is located within the valve seat 64A, received therein from beneath the dip tube retainer 36A. The dip tube retainer vent opening 46A is located in the upper wall of the valve seat 64A. In this regard, air passing from the pumping chamber 50 enters the interior of the valve body 12A and then passes downward into the valve seat vent opening 46A where further movement is checked by the valve body 68 seated therein.

It can thus be appreciated that the exemplary embodiments provide unique configurations of a valve body, trigger pump and check valve assembly which simplifies and reduces the number of parts while also reducing the number of potential leak points between the liquid container and the valve body.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A trigger sprayer for pumping and spraying liquid from a liquid container, said trigger sprayer comprising:

a valve body having a base, a delivery nozzle, a flow passage extending from an interior of said base to said delivery nozzle, a pumping chamber in fluid communication with said flow passage, and a vent opening between said pumping chamber and said interior of said base;

a piston in the pumping chamber, said piston including an inboard seal and an outboard seal, said vent opening being located between said inboard seal and said outboard seal; and a check valve disposed between said vent opening and said interior of said base, wherein the check valve is configured and arranged to prevent liquid from the liquid container from entering the pumping chamber and is configured and arranged to allow atmospheric air to pass from the pumping chamber into the interior of the base during operation of the piston, and wherein said check valve comprises a valve seat extending directly from a wall of said pumping chamber into an interior of said base, and further comprises a valve body within said valve seat.

2. The trigger sprayer of claim 1 further comprising a dip tube retainer received within said base of said valve body, said dip tube retainer including a vent path.

3. The trigger sprayer of claim 2 wherein said vent path is in proximity to said check valve.

4. The trigger sprayer of claim 1 wherein said valve body is elastomeric.

5. The trigger sprayer of claim 4 wherein said valve body is a chevron valve.

6. The trigger sprayer of claim 4 further comprising a clip tube retainer received within said base of said valve body, said dip tube retainer including a vent path.

7. The trigger sprayer of claim 6 wherein said vent path is in proximity to said check valve.

8. A trigger sprayer for pumping and spraying liquid from a liquid container, said trigger sprayer comprising:

a valve body comprising a chevron valve having a base, a delivery nozzle, a flow passage extending from an interior of said base to said delivery nozzle, a pumping chamber in fluid communication with said flow passage, and a vent opening between said pumping chamber and said interior of said base;

a piston in the pumping chamber, said piston including an inboard seal and an outboard seal, said vent opening being located between said inboard seal and said outboard seal;

a dip tube retainer having a body portion received within said base of said valve body, said body portion having a vent path; and a check valve in communication with the vent path and disposed between said interior of said base and an interior of said body portion of said dip tube retainer, wherein said check valve comprises a valve seat extending directly from said pumping chamber, and further comprises a valve body disposed within said valve seat.

9. The trigger sprayer of claim 8 wherein said check valve is in proximity to said vent opening.

10. The trigger sprayer of claim 8 wherein said valve body is elastomeric.

11. The trigger sprayer of claim 10 wherein said check valve is in proximity to said vent opening.

12. A trigger sprayer for pumping and spraying liquid from a liquid container, said trigger sprayer comprising:

a valve body having a base, a delivery nozzle, a flow passage extending from an interior of said base to said delivery nozzle, a pumping chamber in fluid communication with said flow passage, and a vent opening between said pumping chamber and said interior of said base;

a piston in the pumping chamber, said piston including an inboard seal and an outboard seal, said vent opening being located between said inboard seal and said outboard seal;

a dip tube retainer having a body portion received within said base of said valve body, said body portion having a vent path; and a check valve in communication with the vent path and disposed between said interior of said base and an interior of said body portion of said dip tube retainer, wherein the check valve is configured and arranged to prevent liquid from the liquid container from entering the pumping chamber and is configured and arranged to allow atmospheric air to pass from the pumping chamber into the interior of the base during operation of the piston.

13. The trigger sprayer of claim 12 wherein said valve body is elastomeric.

14. The trigger sprayer of claim 13 wherein said check valve is in proximity to said vent opening.

15. The trigger sprayer of claim 12 wherein said valve body is a chevron valve.

16. The trigger sprayer of claim 12 wherein said check valve is in proximity to said vent opening.

* * * * *